US006162047A

United States Patent [19]

Hess

[11] Patent Number: 6,162,047

[45] Date of Patent: Dec. 19, 2000

[54] SIMULATED FUEL BED FOR FIREPLACE

[75] Inventor: Kristoffer Hess, Cambridge, Canada

[73] Assignee: Dimplex North America Limited, Cambridge, Canada

[21] Appl. No.: 09/036,003

[22] Filed: Mar. 4, 1998

[51] Int. Cl.[7] ..... F23Q 2/32

[52] U.S. Cl. ..... 431/125; 126/512

[58] Field of Search ..... 431/125; 126/512, 126/513, 500, 540, 552, 553, 152 B; 362/806; 428/15

[56] References Cited

U.S. PATENT DOCUMENTS

| | | | |
|---|---|---|---|
| 1,867,740 | 7/1932 | Guy | 126/90 R |
| 3,499,239 | 3/1970 | Mungo | 40/428 |
| 3,583,845 | 6/1971 | Palone | 431/125 |
| 3,742,189 | 6/1973 | Conroy et al. | 126/521 |
| 3,978,598 | 9/1976 | Rose et al. | 40/428 |
| 4,026,544 | 5/1977 | Plambeck et al. | 472/64 |
| 4,306,537 | 12/1981 | Mitchell | 126/92 AC |
| 4,573,905 | 3/1986 | Meyers | 431/125 |
| 4,688,548 | 8/1987 | Stoughton | 126/298 |
| 4,726,351 | 2/1988 | Whittaker et al. | 431/125 |
| 4,828,485 | 5/1989 | Jankowski | 431/125 |
| 4,883,043 | 11/1989 | Thow et al. | 126/512 |
| 4,890,600 | 1/1990 | Meyers | 126/512 |
| 4,940,407 | 7/1990 | Rehberg et al. | 431/126 |
| 4,965,707 | 10/1990 | Butterfield | 362/96 |
| 5,000,162 | 3/1991 | Shimek et al. | 126/512 |
| 5,081,981 | 1/1992 | Beal | 126/92 R |
| 5,195,820 | 3/1993 | Rehberg | 126/523 |
| 5,469,839 | 11/1995 | Kasulis et al. | 126/552 |
| 5,642,580 | 7/1997 | Hess et al. | 40/428 |
| 5,839,427 | 11/1998 | Shorts | 126/512 |
| 5,850,830 | 12/1998 | Smith | 126/500 |
| 5,988,159 | 11/1999 | Blount | 126/512 |

FOREIGN PATENT DOCUMENTS

| | | | |
|---|---|---|---|
| 611 921 A2 | 2/1994 | European Pat. Off. | F24C 7/00 |
| 611921 | 2/1994 | European Pat. Off. . | |
| 410123 | 5/1934 | United Kingdom . | |
| 975009 | 11/1964 | United Kingdom . | |
| 1024047 | 3/1966 | United Kingdom . | |
| 1088577 | 10/1967 | United Kingdom . | |
| 1164143 | 9/1969 | United Kingdom . | |
| 1407926 | 10/1975 | United Kingdom . | |
| 1443772 | 7/1976 | United Kingdom . | |
| 1457540 | 12/1976 | United Kingdom . | |
| 2149090 | 6/1985 | United Kingdom . | |
| 2151772 | 7/1985 | United Kingdom . | |
| 2 198 835 | 12/1986 | United Kingdom | F24C 3/04 |
| 2180927 | 4/1987 | United Kingdom . | |
| 2230335 | 10/1990 | United Kingdom . | |
| 2240171 | 7/1991 | United Kingdom . | |
| 2231575 | 9/1991 | United Kingdom . | |
| 2 261 942 | 11/1992 | United Kingdom | F24C 3/04 |
| 2256040 | 11/1992 | United Kingdom . | |
| 2264555 | 9/1993 | United Kingdom . | |
| 2290865 | 1/1996 | United Kingdom . | |
| 2298073 | 8/1996 | United Kingdom . | |
| WO97/41393 | 4/1997 | WIPO . | |

OTHER PUBLICATIONS

EPRI Electric Power Research Institute, *Residential Electric Fireplaces Review of the State of the Art*, May 1997.

*Primary Examiner*—Ira S. Lazarus
*Assistant Examiner*—David Lee

[57] ABSTRACT

A simulated fuel bed for an electric or gas fireplace including an ember bed and a combustible fuel. At least one reflector is mounted to at least one of the ember bed and the combustible fuel in a position to simulate a hot ember by reflecting light transmitted from a light source.

147 Claims, 3 Drawing Sheets

SIMULATED FUEL BED FOR FIREPLACE

FIELD OF THE INVENTION

The present invention relates to components for electric or gas fireplaces and in particular to a simulated fuel bed.

BACKGROUND OF THE INVENTION

Simulated fuel beds are well known for use with electric or gas fireplaces. The fuel beds typically simulate combustible fuel, such as wood logs or lumps of coal, positioned upon an ember bed.

For electric fireplaces, simulated fuel beds are typically molded from plastic, fibreglass and/or ceramic materials that are colored or painted to resemble a combustible fuel arranged on a bed of embers. The appearance of glowing embers is provided by transmitting light from beneath the simulated fuel bed through colored translucent panels on the body of the simulated fuel bed.

For gas fireplaces, the simulated fuel beds are typically formed from cast concrete, ceramics or other suitable flame retardant materials that are painted to resemble a combustible fuel arranged on an ember bed. Rock wool is disposed on parts of the combustible fuel and the ember bed. The wool is heated to incandescence by the gas flames in order to simulate burning embers on the ember bed and on the combustible fuel.

While the use of translucent panels or rock wool provides a reasonably realistic simulated effect of glowing embers, there is a continuing need to improve the effect.

SUMMARY OF THE INVENTION

In one aspect the invention provides a simulated fuel bed for a fireplace incorporating a light source, the simulated fuel bed comprising:

a simulated ember bed;

a simulated combustible fuel; and at least one reflector mounted onto a surface of at least one of said simulated ember bed and said simulated combustible fuel in a position to simulate a hot ember by reflecting light transmitted from the light source, said at least one reflector including a plurality of reflecting regions and non-reflecting regions arranged in an ember pattern, said non-reflecting regions simulating cracks between embers.

In another aspect the invention provides a simulated fuel bed for a fireplace incorporating a light source, the simulated fuel bed comprising:

means for simulating an ember bed;

means for simulating a combustible fuel; and means for reflecting light from the light source to simulate a hot ember, said reflector means being mounted onto a surface of at least one of said ember bed simulation means and said combustible fuel simulation means, and at least some of said reflector means including a plurality of reflecting regions and non-reflecting regions arranged in an ember pattern, said non-reflecting regions simulating cracks between embers.

In another aspect the invention provides a simulated fuel bed for a fireplace incorporating a light source, the simulated fuel bed comprising:

a simulated ember bed defining at least one translucent portion;

a simulated combustible fuel; and at least one reflector mounted onto a surface of at least one of said simulated ember bed and said simulated combustible fuel in a position to simulate a hot ember by reflecting light transmitted from the light source, wherein said at least one reflector is mounted in a downwardly and rearwardly facing position sufficiently opposing said translucent portion of said simulated ember bed to reflect light transmitted through said translucent portion to simulate said ember and sufficiently opposing a reflective screen for the fireplace disposed in a generally vertical plane, wherein said hot ember simulated by said reflector is indirectly observable as a reflected image in said reflective screen.

In another aspect the invention provides a simulated fuel bed for a fireplace incorporating a light source, the simulated fuel bed comprising:

means for simulating an ember bed;

means for simulating a combustible fuel; and means for reflecting light from the light source to simulate a hot ember, said reflector means being mounted onto a surface of at least one of said ember bed simulation means and said combustible fuel simulation means, wherein said ember bed simulation means defines at least one translucent portion for transmitting light from said light source to simulate a hot ember, and wherein said reflector means is mounted in a downwardly and rearwardly facing position sufficiently opposing said translucent portion of said ember bed simulation means to reflect light transmitted through said translucent portion to simulate said ember and sufficiently opposing a reflective screen for the fireplace disposed in a generally vertical plane, wherein said hot ember simulated by said reflector means is indirectly observable as a reflected image in said reflective screen.

In another aspect the invention provides a simulated fuel bed for a fireplace incorporating a light source, the simulated fuel bed comprising:

a simulated ember bed;

a simulated combustible fuel; and at least one reflector mounted onto a surface of at least one of said simulated ember bed and said simulated combustible fuel in a position to simulate a hot ember by reflecting light transmitted from the light source, wherein said reflector is mounted in an upwardly and rearwardly facing position sufficiently opposing a reflective screen for said fireplace disposed in a generally vertical plane to reflect light transmitted through said reflective screen to simulated said ember, wherein said hot ember simulated by said reflector is indirectly observable as a reflected image in said reflective screen.

In another aspect the invention provides a simulated fuel bed for a fireplace incorporating a light source, the simulated fuel bed comprising:

means for simulating an ember bed;

means for simulating a combustible fuel; and means for reflecting light from the light source to simulate a hot ember, said reflector means being mounted onto a surface of at least one of said ember bed simulation means and said combustible fuel simulation means, wherein said reflector means is mounted in an upwardly and rearwardly facing position sufficiently opposing a reflective screen for said fireplace disposed in a generally vertical plane to reflect light transmitted through said reflective screen to simulate said ember, wherein said hot ember simulated by said reflector means is indirectly observable as a reflected image in said reflective screen.

Advantageously, the reflector allows for embers to be simulated, in a cost-effective manner, on portions of the fuel bed that are not translucent (for instance, on solid ceramic logs).

DETAILED DESCRIPTION OF THE PREFERRED EMBODIMENT

Figure 1:
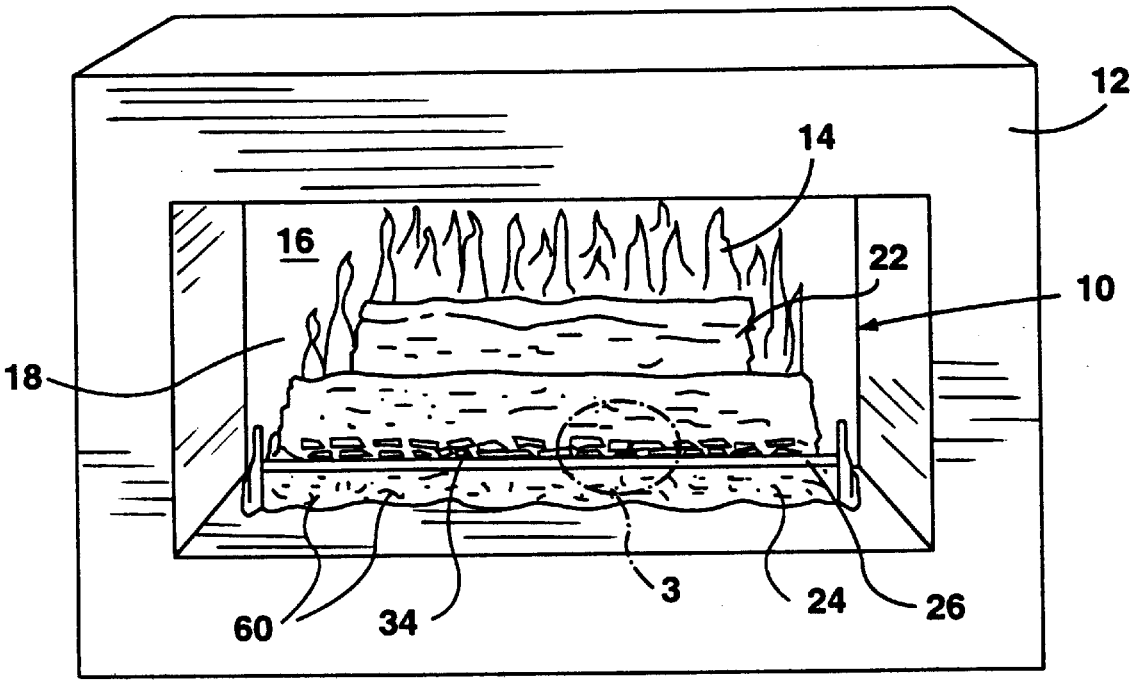
FIG. 1 is a front perspective view of an electric fireplace incorporating a simulated fuel bed in accordance with the present invention.

A simulated fuel bed in accordance with the present invention is shown generally at 10 in FIGS. 1–4. The fuel bed 10 is shown incorporated within an electric fireplace 12.

The preferred electric fireplace 12 produces a simulated image 14 of flames between the fuel bed 10 and a reflected image 10' of the fuel bed 10. The electric fireplace 12 includes a translucent screen 16 having a partially reflecting surface 18 located immediately behind the fuel bed 10 for producing the reflected image 10' of the fuel bed 10. The simulated image 14 of flames is created by reflecting light from a flicker element 20 located behind the screen 16 and transmitting the reflected light through a diffusing region 21 on the screen 16. More detail concerning the structure of the preferred embodiment of electric fireplace 12 is provided in U.S. Pat. Nos. 4,965,707 and 5,642,580 which are incorporated herein by reference. It should be understood however that the invention is intended to be used, with necessary modifications, with other types of electric fireplaces as well as with gas fireplaces.

Figure 2:
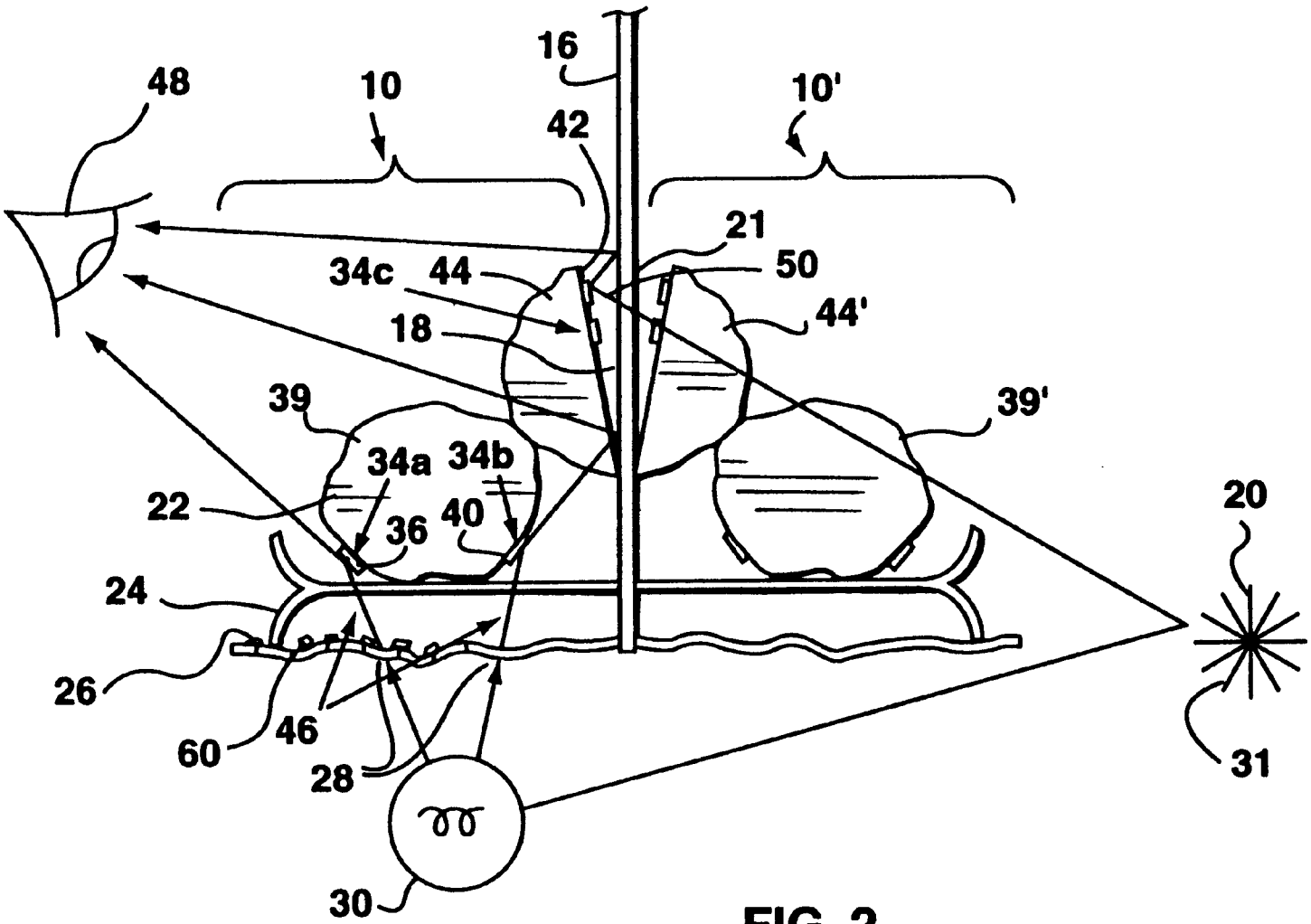
FIG. 2 is a partial side view of the fireplace of FIG. 1.

Referring to FIGS. 1 and 2, it may be seen that the fuel bed 10 has a simulated combustible fuel 22, a simulated ember bed 24 and a real or simulated grate 26. The combustible fuel 22 is preferably formed from an expanded polystyrene material and colored to resemble wood logs. The ember bed 24 is preferably formed from a plastic material having red, orange or yellow colored translucent portions 28 to resemble an ember bed for the logs. The grate 26 is preferably formed from a metal or ceramic material and colored if necessary to resemble the metallic material of a real fireplace grate. The grate 26 is optional and the fuel bed 10 may be only made up of the combustible fuel 22 and ember bed 24. It will be understood that the elements 22, 24 and 26 of the fuel bed 10 may be constructed from any materials that accurately simulate the element in a cost effective and functionally practical manner.

As shown in FIG. 2, a light source 30 such as one or more light bulbs is positioned underneath the simulated fuel bed 10. Light from the light source 30 is transmitted through the colored translucent portions 28 of the ember bed to give the illusion of burning embers. Light from the light source is also transmitted toward the reflecting surface 20 where it is reflected toward the rear of the screen 16 to produce the simulated image 14 of flames. The reflecting surface 20 is preferably rotatable about its center axis 31 so that the simulated flames 14 appear to flicker (as described in more detail in U.S. Pat. No. 5,642,580). In the case where the fuel bed 10 is incorporated within a gas fireplace, the light source 30 could simply comprise the gas flames produced by the fireplace.

A plurality of reflectors 34 are disposed in an ember pattern 33 on parts of the combustible fuel 22 of the fuel bed 10 to reflect light that is transmitted from the light source 30. The reflection of light from the reflectors 34 gives the illusion of burning embers on the combustible fuel. The reflectors 34 may also be disposed on parts of the ember bed 24 where it is otherwise difficult to give the illusion of hot embers by transmitted light through colored translucent portions 28. For instance, red colored reflectors 34 may be mounted to an upwardly facing surface of the ember bed 24 to reflect light from a light source located at the top of the fireplace (not shown).

The reflectors 34 are mounted to the fuel bed 10 using a pressure sensitive glue (such as double-sided tape), a hot melt glue or any other suitable fastener that withstands the temperature associated with the electric or gas fireplaces. It has been found that double-sided tape allows a plurality of reflectors 34 to be applied at one time to a desired portion of the fuel bed 10. A transfer decal (not shown) is formed with the reflectors arranged in an ember pattern 33 as described further below. The sticky side of the decal is then peeled off so the decal can be mounted to the fuel bed 10. The remaining portion of the decal that does not form the reflectors 34 is then peeled away so that all that remains is the reflectors 34 arranged in the ember pattern 33. This allows the reflectors to be mounted to the fuel bed 10 in a cost effective manner with a precise arrangement of reflectors 34 in the ember pattern.

Figure 3:
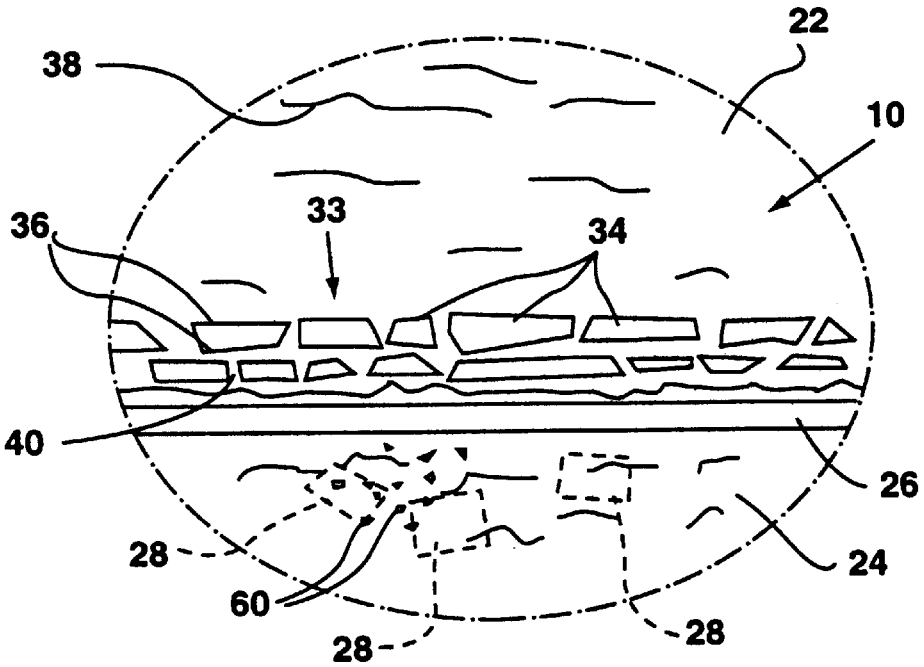
FIG. 3 is an enlarged view of the portion of the fireplace indicated by arrow 3 in FIG. 1 showing a first embodiment of reflector arrangement.

Referring to a first embodiment depicted in FIG. 3, it can be seen that a plurality of reflectors 34, each polygonal in shape, are arranged in the ember pattern 33 with two opposing sides 36 of each reflector 34 extending generally parallel to the simulated grain 38 for the simulated combustible fuel 22. The reflectors 34 are arranged relative to each other such that they follow the grain 38. Wood logs for instance have a grain that extends longitudinally along the log. Lumps of coal also include a grain, although its direction is not apparent from the shape of the lump of coal. The ember pattern 33 of reflectors 34 includes non-reflecting spaces 40 between reflectors 34 to simulate cracks that would be found between embers on a burning fuel. The spaces 40 are generally uniform in width. The size and shape of the reflectors 34 varies however although most of the reflectors 34 will be generally trapezoidal in shape.

Figure 4:
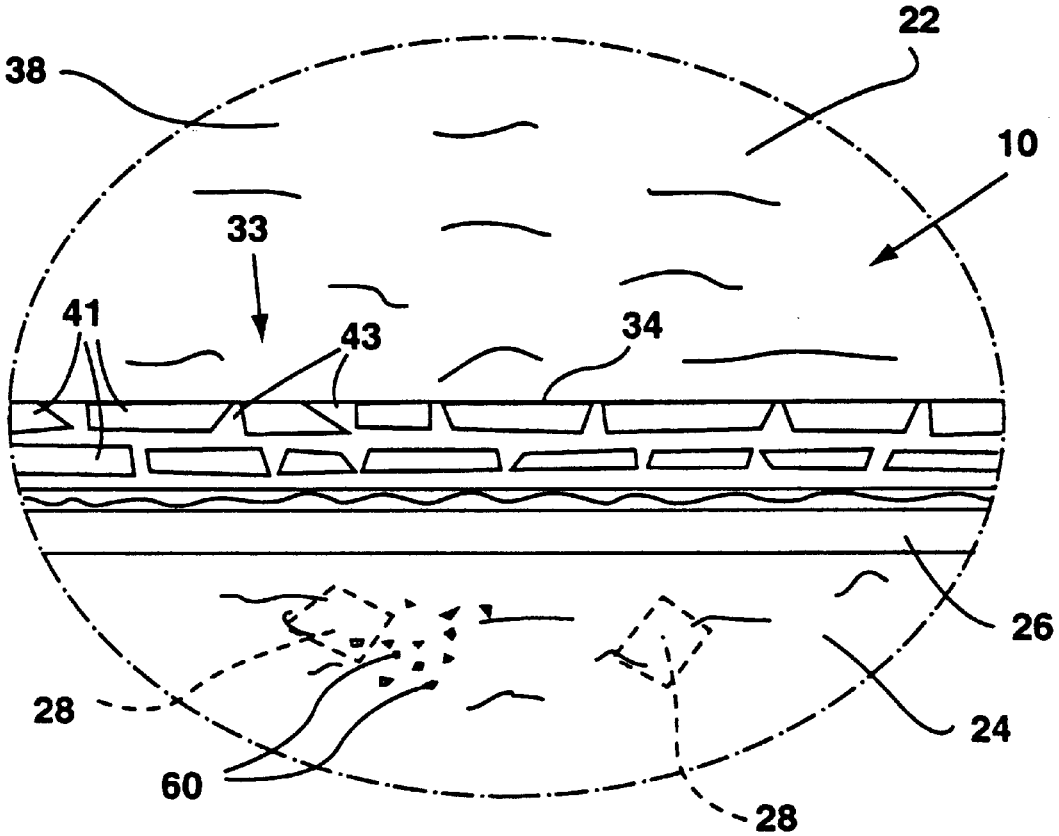
FIG. 4 is an enlarged view of the portion of the fireplace indicated by arrow 3 in FIG. 1 showing a second embodiment of reflector arrangement.
Figure 2:
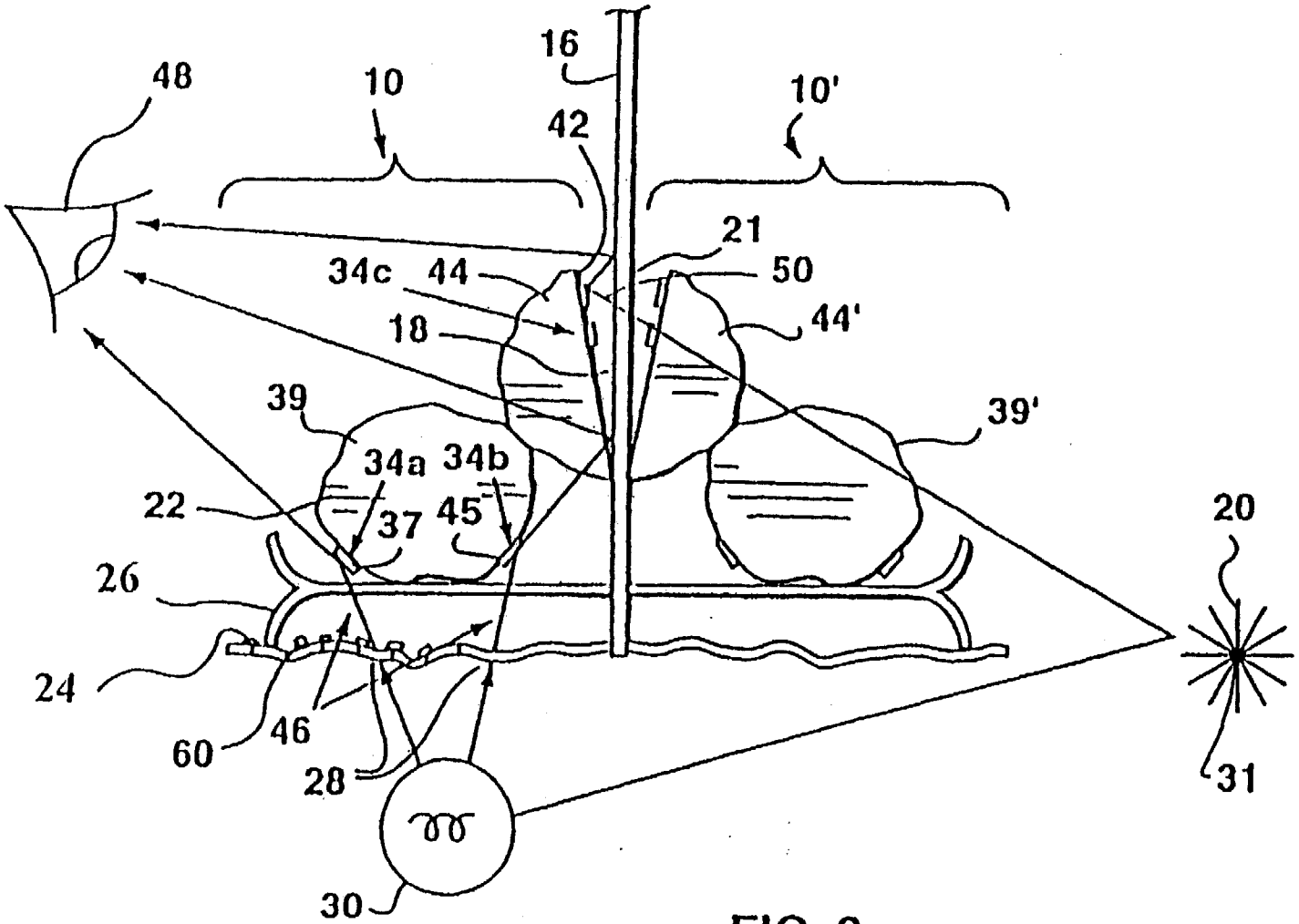

Referring to a second embodiment of reflector 34' depicted in FIG. 4, it can be seen that a single reflector 34' is provided which includes a plurality of reflective regions 41 and non-reflective regions 43. The shape and size of the respective regions 41 and 42 corresponds to the shape and size of the individual reflectors 34 and spaces 40 described for FIG. 3 above. The non-reflective regions 43 of the reflector 34' are formed by etching or by applying a paint, ink or other suitable non-reflective materials to the surface of a reflector 34.

It will be noted in FIG. 2 that the reflectors 34 are positioned in a number of distinct locations on the combustible fuel 22. Reflectors **34*a* are positioned along a downwardly facing front surface 36 of a foreground log 39. Reflectors 34*b* are positioned along a downwardly facing rear surface 40 of the foreground log 39. Reflectors 34*c* are positioned along an upwardly facing rear surface 42 of a background log 44. The background log 44 is split such that it will appear as an entire log when combined with its reflected image 44' observed in the reflective surface 18 of screen 16. The foreground log 39 similarly has a reflected image 39'**.

As shown in FIG. 2, depending upon their location, reflectors **34*a*, 34*b* and 34*c* each function differently in reflecting light from light source 30 to produce an illusion of embers. Reflectors 34***a* and 34*b* reflect light 46 that has been colored by passing through the translucent portions 28 of the ember bed 24. Light from reflectors 34*a* is directly observable by a viewer 48 located in front of the fireplace. Light from reflectors 34*b* is indirectly observable since the light must first be reflected again on the reflecting surface 18 of screen 16 before reaching the eye of the viewer. Reflectors 34*c* reflect light 50 that is transmitted through the diffusing region 21 of the screen 16. Light from reflectors 34*c* is indirectly observable by the viewer 48 since the light must first be reflected by the reflecting surface 18 of screen 16 before reaching the eye of the viewer. Any flickering of the simulated flame 14 that is reflected by the reflector 34*c* gives the enhanced illusion of corresponding changes of heat intensity for the simulated ember.

The reflectors 34 are each formed from a suitable reflective material such as a highly reflective metallic foil. A thin foil of chromed MYLAR™ or metallized polyester has been found to be a suitable material. A red, orange or yellow colored reflective foil is preferred for reflectors 34*c* to enhance the color of the reflected light. A silver colored reflective foil is preferred for reflectors 34*a* and 34*b* where the incident light has already been colored. While foil is currently preferred for forming the reflectors 34, it is also contemplated that reflective glass or other reflective materials may be substituted. For instance, in gas fireplace applications, it may be necessary to utilize a heat resistant mirrored glass for the reflectors 34 where it is found that a foil is affected by the high temperatures. The fuel bed 10 for gas fireplaces of course would also be required to be made from suitable heat resistant materials as known in the art.

In addition to the reflectors 34, it has been found that an enhanced fuel bed effect is generated by randomly sprinkling minute flecks 60 of reflective material on the combustible fuel 22 and ember bed 24. The flecks 60 are formed of a similar reflective metallic foil as is preferred for forming the reflectors 34. The flecks 60 are sufficiently minute in size (two millimeters or less in width) to give the illusion of a sparkling ash. Due to the minute size and random distribution of the flecks (which are disposed in a variety of different angular orientations on the fuel bed 10 to reflect light from different angles above and below the flecks 40), the viewer 48 observes random sparkles of light from the fuel bed 10 for brief instances of time (since the sparkle will disappear when the viewer 48 moves slightly such that the angle of observed reflected light changes). The flecks 60 may be treated with a glue before being sprinkled upon the fuel bed 10 or the fuel bed 10 may be sprayed with a clear adhesive substance prior to sprinkling of the flecks 60.

It is to be understood that what has been described is a preferred embodiment to the invention. The invention nonetheless is susceptible to certain changes and alternative embodiments fully comprehended by the spirit of the invention as described above, and the scope of the claims set out below.

I claim:

1. A simulated fuel bed for a fireplace incorporating a light source, the simulated fuel bed comprising:

a simulated ember bed;

a simulated combustible fuel; and at least one reflector mounted onto a surface of at least one of said simulated ember bed and said simulated combustible fuel in a position to simulate a hot ember by reflecting light transmitted from the light source, said at least one reflector including a plurality of reflecting regions and non-reflecting regions arranged in an ember pattern, said non-reflecting regions simulating cracks between embers.

2. A simulated fuel bed as claimed in claim 1 further comprising a grate disposed between said simulated combustible fuel and said simulated ember bed.

3. A simulated fuel bed as claimed in claim 1, wherein said simulated ember bed and said stimulated combustible fuel are integrally formed.

4. A simulated fuel bed as claimed in claim 1, wherein said simulated combustible fuel resembles at least one log of wood.

5. A simulated fuel bed as claimed in claim 1, wherein said simulated combustible fuel resembles at least one lump of coal.

6. A simulated fuel bed as claimed in claim 1, wherein said fuel bed is incorporated within an electric fireplace.

7. A simulated fuel bed as claimed in claim 1, wherein said fuel bed is incorporated within a gas fireplace.

8. A simulated fuel bed as claimed in claim 1, wherein said reflector is generally polygonal in shape.

9. A simulated fuel bed as claimed in claim 8, wherein two sides of each said reflector extend generally parallel to an axis of said simulated combustible fuel corresponding to a simulated grain.

10. A simulated fuel bed as claimed in claim 1, wherein said reflector is generally silver in color.

11. A simulated fuel bed as claimed in claim 1, wherein said reflector is one of generally red, orange or yellow in color.

12. A simulated fuel bed as claimed in claim 1, wherein said reflector is formed from a reflective metallic foil.

13. A simulated fuel bed as claimed in claim 1, wherein said reflector is formed from a mirrored glass.

14. A simulated fuel bed as claimed in claim 1, wherein said simulated ember bed defines at least one translucent portion for transmitting light from said light source to simulate a hot ember.

15. A simulated fuel bed as claimed in claim 14, wherein said reflector is mounted to said simulated combustible fuel in a downwardly facing position sufficiently opposing said translucent portion of said simulated ember bed to reflect light transmitted through said translucent portion to simulate said ember.

16. A simulated fuel bed as claimed in claim 1, wherein said light source is a gas flame.

17. A simulated fuel bed as claimed in claim 1, further comprising a plurality of reflective flecks disposed on said fuel bed.

18. A simulated fuel bed as claimed in claim 17, wherein said flecks are two millimeters or less in width.

19. A simulated fuel bed as claimed in claim 1, wherein said reflector is mounted to said simulated combustible fuel in an upwardly facing position for reflecting light from a light source located above said fuel bed to simulate said hot ember.

20. A simulated fuel bed for a fireplace incorporating a light source, the simulated fuel bed comprising:

means for simulating an ember bed;

means for simulating a combustible fuel; and means for reflecting light from the light source to simulate a hot ember, said reflector means being mounted onto a surface of at least one of said ember bed simulation means and said combustible fuel simulation means, and at least some of said reflector means including a plurality of reflecting regions and non-reflecting regions arranged in an ember pattern, said non-reflecting regions simulating cracks between embers.

21. A simulated fuel bed as claimed in claim 20 further comprising a grate disposed between said combustible fuel simulation means and said ember bed simulation means.

22. A simulated fuel bed as claimed in claim 20, wherein said ember bed simulation means and said combustible fuel simulation means are integrally formed.

23. A simulated fuel bed as claimed in claim 20, wherein said combustible fuel simulation means resembles at least one log of wood.

24. A simulated fuel bed as claimed in claim 20, wherein said combustible fuel simulation means resembles at least one lump of coal.

25. A simulated fuel bed as claimed in claim 20, wherein said fuel bed is incorporated within an electric fireplace.

26. A simulated fuel bed as claimed in claim 20, wherein said fuel bed is incorporated within a gas fireplace.

27. A simulated fuel bed as claimed in claim 20, wherein said reflector means is generally polygonal in shape.

28. A simulated fuel bed as claimed in claim 27, wherein two sides of each said reflector means extend generally parallel to an axis of said combustible fuel simulation means corresponding to a simulated grain.

29. A simulated fuel bed as claimed in claim 20, wherein said reflector means is generally silver in color.

30. A simulated fuel bed as claimed in claim 20, wherein said reflector means is one of generally red, orange or yellow in color.

31. A simulated fuel bed as claimed in claim 20, wherein said reflector means is formed from a reflective metallic foil.

32. A simulated fuel bed as claimed in claim 20, wherein said reflector means is formed from a mirrored glass.

33. A simulated fuel bed as claimed in claim 20, wherein said ember bed simulation means defines at least one translucent portion for transmitting light from said light source to simulate a hot ember.

34. A simulated fuel bed as claimed in claim 33, wherein said reflector means is mounted to said combustible fuel simulation means in a downwardly facing position sufficiently opposing said translucent portion of said ember bed simulation means to reflect light transmitted through said translucent portion to simulate said ember.

35. A simulated fuel bed as claimed in claim 20, wherein said light source is a gas flame.

36. A simulated fuel bed as claimed in claim 20, further comprising a plurality of reflective flecks disposed on said fuel bed.

37. A simulated fuel bed as claimed in claim 36, wherein said flecks are two millimeters or less in width.

38. A simulated fuel bed as claimed in claim 20, wherein said reflector means is mounted to combustible fuel simulation means in an upwardly facing position for reflecting light from a light source located above said fuel bed to simulate said hot ember.

39. A simulated fuel bed for a fireplace incorporating a light source, the simulated fuel bed comprising:

a simulated ember bed defining at least one translucent portion;

a simulated combustible fuel; and at least one reflector mounted onto a surface of at least one of said simulated ember bed and said simulated combustible fuel in a position to simulate a hot ember by reflecting light transmitted from the light source, wherein said at least one reflector is mounted in a downwardly and rearwardly facing position sufficiently opposing said translucent portion of said simulated ember bed to reflect light transmitted through said translucent portion to simulate said ember and sufficiently opposing a reflective screen for the fireplace disposed in a generally vertical plane, wherein said hot ember simulated by said reflector is indirectly observable as a reflected image in said reflective screen.

40. A simulated fuel bed as claimed in claim 39 further comprising a grate disposed between said simulated combustible fuel and said simulated ember bed.

41. A simulated fuel bed as claimed in claim 39, wherein said simulated ember bed and said simulated combustible fuel are integrally formed.

42. A simulated fuel bed as claimed in claim 39, wherein said simulated combustible fuel resembles at least one log of wood.

43. A simulated fuel bed as claimed in claim 39, wherein said simulated combustible fuel resembles at least one lump of coal.

44. A simulated fuel bed as claimed in claim 39, wherein said fuel bed is incorporated within an electric fireplace.

45. A simulated fuel bed as claimed in claim 39, wherein said fuel bed is incorporated within a gas fireplace.

46. A simulated fuel bed as claimed in claim 39, wherein said reflector is generally polygonal in shape.

47. A simulated fuel bed as claimed in claim 39, wherein two sides of each said reflector extend generally parallel to an axis of said simulated combustible fuel corresponding to a simulated grain.

48. A simulated fuel bed as claimed in claim 39, wherein a plurality of said reflectors are arranged in an ember pattern, said ember pattern including non-reflecting spaces between adjacent reflectors to simulate cracks between embers.

49. A simulated fuel bed as claimed in claim 39, wherein said reflector includes a plurality of reflecting regions and non-reflecting regions arranged in an ember pattern, said non-reflecting regions simulating cracks between embers.

50. A simulated fuel bed as claimed in claim 39, wherein said reflector is generally silver in color.

51. A simulated fuel bed as claimed in claim 39, wherein said reflector is one of generally red, orange or yellow in color.

52. A simulated fuel bed as claimed in claim 39, wherein said reflector is formed from a reflective metallic foil.

53. A simulated fuel bed as claimed in claim 39, wherein said reflector is formed from a mirrored glass.

54. A simulated fuel bed as claimed in claim 39, wherein said light source is a gas flame.

55. A simulated fuel bed as claimed in claim 39, further comprising a plurality of reflective flecks disposed on said fuel bed.

56. A simulated fuel bed as claimed in claim 39, wherein said flecks are two millimeters or less in width.

57. A simulated fuel bed for a fireplace incorporating a light source, the simulated fuel bed comprising:

means for simulating an ember bed;

means for simulating a combustible fuel; and means for reflecting light from the light source to simulate a hot ember said reflector means being mounted onto a surface of at least one of said ember bed simulation means and said combustible fuel simulation means, wherein said ember bed simulation means defines at least one translucent portion for transmitting light from said light source to simulate a hot ember, and wherein said reflector means is mounted in a downwardly and rearwardly facing position sufficiently opposing said translucent portion of said ember bed simulation means to reflect light transmitted through said translucent portion to simulate said ember and sufficiently opposing a reflective screen for the fireplace disposed in a generally vertical plane, wherein said hot ember simulated by said reflector means is indirectly observable as a reflected image in said reflective screen.

58. A simulated fuel bed as claimed in claim 57 further comprising a grate disposed between said combustible fuel simulation means and said ember bed simulation means.

59. A simulated fuel bed as claimed in claim 57, wherein said ember bed simulation means and said combustible fuel simulation means are integrally formed.

60. A simulated fuel bed as claimed in claim 57, wherein said combustible fuel simulation means resembles at least one log of wood.

61. A simulated fuel bed as claimed in claim 57, wherein said combustible fuel simulation means resembles at least one lump of coal.

62. A simulated fuel bed as claimed in claim 57, wherein said fuel bed is incorporated within an electric fireplace.

63. A simulated fuel bed as claimed in claim 57, wherein said fuel bed is incorporated within a gas fireplace.

64. A simulated fuel bed as claimed in claim 57, wherein said reflector means is generally polygonal in shape.

65. A simulated fuel bed as claimed in claim 57, wherein two sides of each said reflector means extend generally parallel to an axis of said combustible fuel simulation means corresponding to a simulated grain.

66. A simulated fuel bed as claimed in claim 57, wherein a plurality of said reflectors are arranged in an ember pattern, said ember pattern including non-reflecting spaces between adjacent reflectors to simulate cracks between embers.

67. A simulated fuel bed as claimed in claim 57, wherein said reflector means includes a plurality of reflecting regions and non-reflecting regions arranged in an ember pattern, said non-reflecting regions simulating cracks between embers.

68. A simulated fuel bed as claimed in claim 57, wherein said reflector means is generally silver in color.

69. A simulated fuel bed as claimed in claim 57, wherein said reflector means is one of generally red, orange or yellow in color.

70. A simulated fuel bed as claimed in claim 57, wherein said reflector means is formed from a reflective metallic foil.

71. A simulated fuel bed as claimed in claim 57, wherein said reflector means is formed from a mirrored glass.

72. A simulated fuel bed as claimed in claim 57, wherein said light source is a gas flame.

73. A simulated fuel bed as claimed in claim 57, further comprising a plurality of reflective flecks disposed on said fuel bed.

74. A simulated fuel bed as claimed in claim 57, wherein said flecks are two millimeters or less in width.

75. A simulated fuel bed for a fireplace incorporating a light source, the simulated fuel bed comprising:

a simulated ember bed;

a simulated combustible fuel; and at least one reflector mounted onto a surface of at least one of said simulated ember bed and said simulated combustible fuel in a position to simulate a hot ember by reflecting light transmitted from the light source, wherein said reflector is mounted in an upwardly and rearwardly facing position sufficiently opposing a reflective screen for said fireplace disposed in a generally vertical plane to reflect light transmitted through said reflective screen to simulated said ember, wherein said hot ember simulated by said reflector is indirectly observable as a reflected image in said reflective screen.

76. A simulated fuel bed as claimed in claim 75 further comprising a grate disposed between said simulated combustible fuel and said simulated ember bed.

77. A simulated fuel bed as claimed in claim 75, wherein said simulated ember bed and said simulated combustible fuel are integrally formed.

78. A simulated fuel bed as claimed in claim 75, wherein said simulated combustible fuel resembles at least one log of wood.

79. A simulated fuel bed as claimed in claim 75, wherein said simulated combustible fuel resembles at least one lump of coal.

80. A simulated fuel bed as claimed in claim 75, wherein said fuel bed is incorporated within an electric fireplace.

81. A simulated fuel bed as claimed in claim 75, wherein said fuel bed is incorporated within a gas fireplace.

82. A simulated fuel bed as claimed in claim 75, wherein said reflector is generally polygonal in shape.

83. A simulated fuel bed as claimed in claim 75, wherein two sides of each said reflector extend generally parallel to an axis of said simulated combustible fuel corresponding to a simulated grain.

84. A simulated fuel bed as claimed in claim 75, wherein a plurality of said reflectors are arranged in an ember pattern, said ember pattern including non-reflecting spaces between adjacent reflectors to simulate cracks between embers.

85. A simulated fuel bed as claimed in claim 75, wherein said reflector includes a plurality of reflecting regions and non-reflecting regions arranged in an ember pattern, said non-reflecting regions simulating cracks between embers.

86. A simulated fuel bed as claimed in claim 75, wherein said reflector is generally silver in color.

87. A simulated fuel bed as claimed in claim 75, wherein said reflector is one of generally red, orange or yellow in color.

88. A simulated fuel bed as claimed in claim 75, wherein said reflector is formed from a reflective metallic foil.

89. A simulated fuel bed as claimed in claim 75, wherein said reflector is formed from a mirrored glass.

90. A simulated fuel bed as claimed in claim 75, wherein said light source is a gas flame.

91. A simulated fuel bed as claimed in claim 75, further comprising a plurality of reflective flecks disposed on said fuel bed.

92. A simulated fuel bed as claimed in claim 75, wherein said flecks are two millimeters or less in width.

93. A simulated fuel bed for a fireplace incorporating a light source the simulated fuel bed comprising:

means for simulating an ember bed;

means for simulating a combustible fuel; and means for reflecting light from the light source to simulate a hot ember, said reflector means being mounted onto a surface of at least one of said ember bed simulation means and said combustible fuel simulation means, wherein said reflector means is mounted in an upwardly and rearwardly facing position sufficiently opposing a reflective screen for said fireplace disposed in a generally vertical plane to reflect light transmitted through said reflective screen to simulate said ember, wherein said hot ember simulated by said reflector means is indirectly observable as a reflected image in said reflective screen.

94. A simulated fuel bed as claimed in claim 93 further comprising a grate disposed between said combustible fuel simulation means and said ember bed simulation means.

95. A simulated fuel bed as claimed in claim 93, wherein said ember bed simulation means and said combustible fuel simulation means are integrally formed.

96. A simulated fuel bed as claimed in claim 93, wherein said combustible fuel simulation means resembles at least one log of wood.

97. A simulated fuel bed as claimed in claim 93, wherein said combustible fuel simulation means resembles at least one lump of coal.

98. A simulated fuel bed as claimed in claim 93, wherein said fuel bed is incorporated within an electric fireplace.

99. A simulated fuel bed as claimed in claim 93, wherein said fuel bed is incorporated within a gas fireplace.

100. A simulated fuel bed as claimed in claim 93, wherein said reflector means is generally polygonal in shape.

101. A simulated fuel bed as claimed in claim 93, wherein two sides of each said, reflector means extend generally parallel to an axis of said combustible fuel simulation means corresponding to a simulated grain.

102. A simulated fuel bed as claimed in claim 93, wherein a plurality of said reflectors are arranged in an ember pattern, said ember pattern including non-reflecting spaces between adjacent reflectors to simulate cracks between embers.

103. A simulated fuel bed as claimed in claim 93, wherein said reflector means includes a plurality of reflecting regions and non-reflecting regions arranged in an ember pattern, said non-reflecting regions simulating cracks between embers.

104. A simulated fuel bed as claimed in claim 93, wherein said reflector means is generally silver in color.

105. A simulated fuel bed as claimed in claim 93, wherein said reflector means is one of generally red, orange or yellow in color.

106. A simulated fuel bed as claimed in claim 93, wherein said reflector means is formed from a reflective metallic foil.

107. A simulated fuel bed as claimed in claim 93, wherein said reflector means is formed from a mirrored glass.

108. A simulated fuel bed as claimed in claim 93, wherein said ember bed simulation means defines at least one translucent portion for transmitting light from said light source to simulate a hot ember.

109. A simulated fuel bed as claimed in claim 93, wherein said light source is a gas flame.

110. A simulated fuel bed as claimed in claim 93, further comprising a plurality of reflective flecks disposed on said fuel bed.

111. A simulated fuel bed as claimed in claim 93, wherein said flecks are two millimeters or less in width.

112. A simulated fuel bed for a fireplace incorporating a light source, the simulated fuel bed comprising:

a simulated ember bed;

a simulated combustible fuel; and a plurality of reflectors mounted onto a surface of at least one of said simulated ember bed and said simulated combustible fuel in a position to simulate a hot ember by reflecting light transmitted from the light source, said plurality of reflectors being arranged in an ember pattern, said ember pattern including non-reflecting spaces between adjacent reflectors to simulate cracks between embers.

113. A simulated fuel bed as claimed in claim 112 further comprising a grate disposed between said simulated combustible fuel and said simulated ember bed.

114. A simulated fuel bed as claimed in claim 112, wherein said simulated ember bed and said simulated combustible fuel are integrally formed.

115. A simulated fuel bed as claimed in claim 112, wherein said simulated combustible fuel resembles at least one log of wood.

116. A simulated fuel bed as claimed in claim 112, wherein said simulated combustible fuel resembles at least one lump of coal.

117. A simulated fuel bed as claimed in claim 112, wherein said fuel bed is incorporated within an electric fireplace.

118. A simulated fuel bed as claimed in claim 112, wherein said fuel bed is incorporated within a gas fireplace.

119. A simulated fuel bed as claimed in claim 112, wherein said reflector is generally polygonal in shape.

120. A simulated fuel bed as claimed in claim 119, wherein two sides of each said reflector extend generally parallel to an axis of said simulated combustible fuel corresponding to a simulated grain.

121. A simulated fuel bed as claimed in claim 112, wherein said reflector is generally silver in color.

122. A simulated fuel bed as claimed in claim 112, wherein said reflector is one of generally red, orange or yellow in color.

123. A simulated fuel bed as claimed in claim 112, wherein said reflector is formed from a reflective metallic foil.

124. A simulated fuel bed as claimed in claim 112, wherein said reflector is formed from a mirrored glass.

125. A simulated fuel bed as claimed in claim 112, wherein said simulated ember bed defines at least one translucent portion for transmitting light from said light source to simulate a hot ember.

126. A simulated fuel bed as claimed in claim 125, wherein said reflector is mounted to said simulated combustible fuel in a downwardly facing position sufficiently opposing said translucent portion of said simulated ember bed to reflect light transmitted through said translucent portion to simulate said ember.

127. A simulated fuel bed as claimed in claim 112, wherein said light source is a gas flame.

128. A simulated fuel bed as claimed in claim 112, further comprising a plurality of reflective flecks disposed on said fuel bed.

129. A simulated fuel bed as claimed in claim 128, wherein said flecks are two millimeters or less in width.

130. A simulated fuel bed for a fireplace incorporating a light source, the simulated fuel bed comprising:

means for simulating an ember bed;

means for simulating a combustible fuel; and means for reflecting light from the light source to simulate a hot ember, said reflector means being mounted onto a surface of at least one of said ember bed simulation means and said combustible fuel simulation means, said reflector means being arranged in an ember pattern, said ember pattern including non-reflecting spaces between adjacent reflecting means to simulate cracks between embers.

131. A simulated fuel bed as claimed in claim 130 further comprising a grate disposed between said combustible fuel simulation means and said ember bed simulation means.

132. A simulated fuel bed as claimed in claim 130, wherein said ember bed simulation means and said combustible fuel simulation means are integrally formed.

133. A simulated fuel bed as claimed in claim 130, wherein said combustible fuel simulation means resembles at least one log of wood.

134. A simulated fuel bed as claimed in claim 130, wherein said combustible fuel simulation means resembles at least one lump of coal.

135. A simulated fuel bed as claimed in claim 130, wherein said fuel bed is incorporated within an electric fireplace.

136. A simulated fuel bed as claimed in claim 130, wherein said fuel bed is incorporated within a gas fireplace.

137. A simulated fuel bed as claimed in claim 130, wherein said reflector means is generally polygonal in shape.

138. A simulated fuel bed as claimed in claim 130, wherein two sides of each said reflector means extend generally parallel to an axis of said combustible fuel simulation means corresponding to a simulated grain.

139. A simulated fuel bed as claimed in claim 130, wherein said reflector means is generally silver in color.

140. A simulated fuel bed as claimed in claim 130, wherein said reflector means is one of generally red, orange or yellow in color.

141. A simulated fuel bed as claimed in claim 130, wherein said reflector means is formed from a reflective metallic foil.

142. A simulated fuel bed as claimed in claim 130, wherein said reflector means is formed from a mirrored glass.

143. A simulated fuel bed as claimed in claim 130, wherein said ember bed simulation means defines at least one translucent portion for transmitting light from said light source to simulate a hot ember.

144. A simulated fuel bed as claimed in claim 130, wherein said reflector means is mounted to said combustible fuel simulation means in a downwardly facing position sufficiently opposing said translucent portion of said ember bed simulation means to reflect light transmitted through said translucent portion to simulate said ember.

145. A simulated fuel bed as claimed in claim 130, wherein said light source is a gas flame.

146. A simulated fuel bed as claimed in claim 130, further comprising a plurality of reflective flecks disposed on said fuel bed.

147. A simulated fuel bed as claimed in claim 130, wherein said flecks are two millimeters or less in width.

* * * * *

UNITED STATES PATENT AND TRADEMARK OFFICE

CERTIFICATE OF CORRECTION

PATENT NO. : 6,162,047
DATED : December 19, 2000
INVENTOR(S) : Kristoffer Hess

It is certified that error appears in the above-identified patent and that said Letters Patent is hereby corrected as shown below:

Drawings,
Figure 2, Change "24" to -- 26 --.
Change "26" to -- 24 --.
Change "36" to -- 37 --.
Change "40" to -- 45 --.
Amend lead line to numeral 31.
A corrected Figure 2 is attached as Page 2.
Figure 4, change "34" to -- 34' --.
A corrected Figure 4 is attached as Page 3.

Column 4,
Line 47, change "42" to -- 43 --.
Line 56, change "36" to -- 37 --.
Line 58, change "40" to -- 45 --.

Column 5,
Line 43, change "40" to -- 60 --.

Signed and Sealed this

Twenty-ninth Day of January, 2002

*Attest:*

*Attesting Officer*

JAMES E. ROGAN
*Director of the United States Patent and Trademark Office*